US007791492B2

(12) United States Patent
Nam et al.

(10) Patent No.: US 7,791,492 B2
(45) Date of Patent: Sep. 7, 2010

(54) WIRELESS COMMUNICATION BASED SAFER STREET LAMP CONTROL SYSTEM

(75) Inventors: Kee-Young Nam, Changwon-si (KR); Jae-Duck Lee, Changwon-si (KR); Seong-Hwan Jeong, Busan-si (KR)

(73) Assignee: Korean Electro Technology Research Institute, Sungju-dong, Changwon-si, Kyungsangnam-do (KR)

( * ) Notice: Subject to any disclaimer, the term of this patent is extended or adjusted under 35 U.S.C. 154(b) by 343 days.

(21) Appl. No.: 11/896,113

(22) Filed: Aug. 29, 2007

(65) Prior Publication Data

US 2008/0143493 A1 Jun. 19, 2008

(30) Foreign Application Priority Data

Dec. 19, 2006 (KR) ..... 10-2006-0129868
Dec. 19, 2006 (KR) ..... 10-2006-0130261

(51) Int. Cl.
*G08B 21/00* (2006.01)
*H05B 37/00* (2006.01)
*H05B 39/00* (2006.01)
*H05B 41/00* (2006.01)

(52) U.S. Cl. ..... 340/635; 340/641; 315/312; 315/315

(58) Field of Classification Search ..... 340/310.11–310.18, 286.02, 641, 642, 644; 315/86, 87, 88–93, 160–166; 362/11, 13, 362/431

See application file for complete search history.

(56) References Cited

U.S. PATENT DOCUMENTS 4,580,099 A * 4/1986 Zetti ..... 324/414
5,095,502 A * 3/1992 Finzel ..... 379/40
5,471,201 A * 11/1995 Cerami et al. ..... 340/641
5,734,230 A * 3/1998 Edwards et al. ..... 315/86
5,811,975 A * 9/1998 Bernardo ..... 324/414
5,962,991 A * 10/1999 Levy ..... 315/312
6,489,733 B1 * 12/2002 Schmidt et al. ..... 315/312

* cited by examiner

*Primary Examiner*—Jennifer Mehmood
(74) *Attorney, Agent, or Firm*—Robert E. Bushnell, Esq.

(57) ABSTRACT

Disclosed is a street lamp control system, which cuts off power sources only around an abnormal street lamp where an electric leakage or dangerous situation occurs and allows the rest street lamps to be kept being turned on. The street lamp control system is positioned in a region divided by a plurality of areas where a predetermined number of street lamps are installed. A distribution panel is installed in each center of the areas, and includes two power source control switching circuits for controlling right and left power sources of the corresponding areas. The power source control switching circuit of the corresponding distribution panel turns off the right and left street lamps including the corresponding street lamp when an abnormal state is sensed on a specific street lamp of a specific area, and a power is supplied to the right and left street lamps to be turned on excluding the abnormal street lamp.

9 Claims, 8 Drawing Sheets

WIRELESS COMMUNICATION BASED SAFER STREET LAMP CONTROL SYSTEM

CLAIM OF PRIORITY

This application makes reference to, incorporates the same herein, and claims all benefits accruing under 35 U.S.C. §119 from applications for CONTROL SYSTEM FOR STREET LAMP earlier filed in the Korean Intellectual Property Office on 19 Dec. 2006 and there duly assigned Serial No. 10-2006-0129868, and for REMOTE STREETLIGHTS CONTROL & MONITORING SYSTEM BASED ON ZIGBEE earlier filed in the Korean Intellectual Property Office on 19 Dec. 2006 and there duly assigned Serial No. 10-2006-0130261, respectively.

BACKGROUND OF THE INVENTION

1. Field of the Invention

The present invention disclosed herein relates to a street lamp control system, and more particularly, to a wireless communication based safer street lamp control system which cuts off power sources around a street lamp where an electric leakage or dangerous situation occurs among street lamps and allows the rest street lamps to be turned on, and a remote street lamp control system using a Zigbee technique having a transmission distance of about 100 m.

2. Description of the Prior Art

A street lamp system currently employed (by most autonomous entities) has a distribution panel A with one or two electric circuit breakers therein in accordance with whether every other street lamp is turned on as shown in FIG. 1, thereby controlling turning-on/off of the whole street lamps.

When an electric leakage or other problems on safety and function occur even on any one of the street lamps, a power source is collectively cut off all lamps of right or left section in FIG. 1, which are a series of street lamps connected to the abnormal street lamp, so that these street lamps could not perform the respective functions of illumination.

As a result, the loss of illumination causes the passages of vehicles and people passing by the corresponding street lamps to occur many dangers and obstacles.

Meanwhile, a plurality of street lamps are generally connected to a line branched off from the distribution panel. The existing street lamp control system is configured to cut off the power source from the whole street lamps even when any one of the installed street lamps is out of order due to an electric leakage or the like.

Recently, power line communication technique as one of communication methods are employed for controlling these street lamps.

It is however impossible for power line communication technique to control street lamps when an electric leakage occurs. The electric leakage causes power to be cut off from the street lamp to which the electric leakage occurs, and there are no communication channel when the electric leakage occurs.

It is a similar case for the case of submerging. If cable is submerged and there are parallel current path, then most of signals flow through water to return path, not through load to return path because water has low impedance and this also makes difficult to communicate.

Accordingly, the power line communication scheme cut off the power source of the distribution panel connected to street lamps in an area group where the abnormal street lamps belongs when a dangerous factor on safety including an electric shock or a malfunction occurs on the street lamp so that the only group control of turning off the street lamps can be implemented, however, the individual control for the abnormal street lamp can not be implemented.

SUMMARY OF THE INVENTION

It is therefore an object of the present invention to provide a wireless communication based safer street lamp control system, which controls street lamps and power sources so as to have abnormal street lamp(s) isolated from its power source and allow the rest to be supplied with the respective powers when dangerous factors on safety including an electric shock or malfunction occurs on the abnormal street lamp(s), thereby minimizing the risk to be caused by the turned-off street lamp(s).

It is another object of the present invention to provide a monitoring and control function to street lamp control system, employing low power radio communication technique, to enhance reliability and safety allowing the street lamps to be controlled in a group or individual way.

An aspect of the present invention provides a street lamp control system in a region divided by a plurality of areas where a predetermined number of street lamps are installed, which comprises a distribution panel installed in each center of the area, and includes two power source control switching circuits for controlling right and left power sources of the corresponding areas, wherein the power source control switching circuit of the corresponding distribution panel turns off the right and left street lamps including the corresponding street lamp when an abnormal state is sensed on a specific street lamp of a specific area group, and a power is supplied to the right and left street lamps to be turned on excluding the abnormal street lamp.

To this end, the distribution panel may preferably sense an abnormal state of the street lamp and may transmit the sensed result to a control center in a remote way to turn off the power source of the corresponding street lamp, the abnormal state of the street lamp may be sensed by a current or voltage sensor.

A wireless communication based safer street lamp control system which implemented with present invention using low power radio communication, comprises: a street lamp light controller installed on each street lamp poles which exchange information with a local controller and control each respective street lamp in accordance with a individual control command or a group control command from the local controller; the local controller exchanging information and transceiving (transmitting & receiving) a control command with the street lamp light controller installed on the street lamp poles to control individual and group of the street lamps; and a central control center controlling the local controller to enable the street lamps to be controlled in group and individual ways, wherein the local controller and the street lamp light controller are connected with a low power radio communication way, and the local controller and the central control center are connected via a bidirectional radio communication network.

In the present invention, the wireless communication based safer street lamp light controller may comprise: a microprocessor processing general functions including information transmission, information storage, and state display; a radio communication unit/Zigbee module for receiving a control command from the local controller; a current and voltage sensor for sensing an abnormal state of the street lamp; an A/D converter for converting an analog signal of the street lamp sensed by the current and voltage sensor into a digital signal and outputting the digital signal to the microprocessor; a constant voltage supply unit supplying a power; and a relay driving circuit driving the relay of the distribution panel to cut off a power of the corresponding street lamps in accordance with the received control command.

Meanwhile, the local controller may comprise: a microprocessor for processing general functions including information transmission, information storage, and state display; a radio communication unit/Zigbee module communicating with the street lamp light controller; a radio communication unit for exchanging information with a control computer of the central control center; a display device displaying various measurements and communication states; a state display LED for displaying an operating state of the local controller; an external I/F unit for performing maintenance and data update of the local controller; and a constant voltage supply unit for supplying a power.

A further understanding of the nature and advantages of the present invention herein may be realized by reference to the remaining portions of the specification and the attached drawings.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
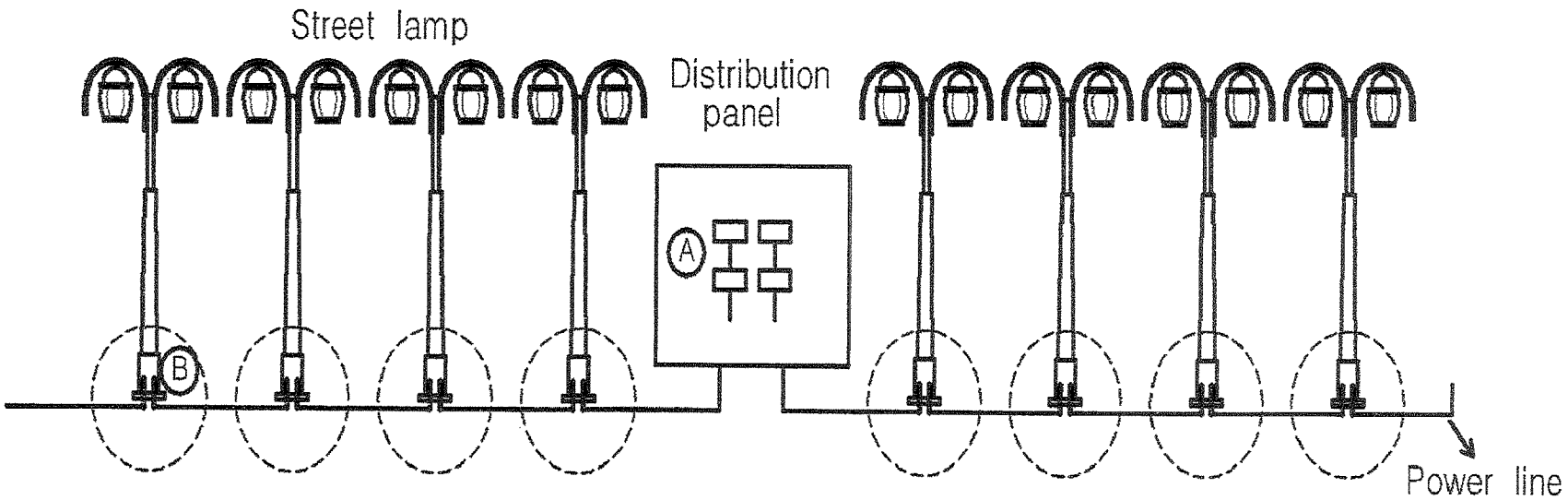
FIG. 1 (PRIOR ART)
FIG. 1 is a view illustrating connections of a conventional street lamp control system.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Like reference numerals refer to like elements throughout the accompanying figures.

Hereinafter, it will be described about an exemplary embodiment of the present invention in conjunction with the accompanying drawings.

Figure 2:
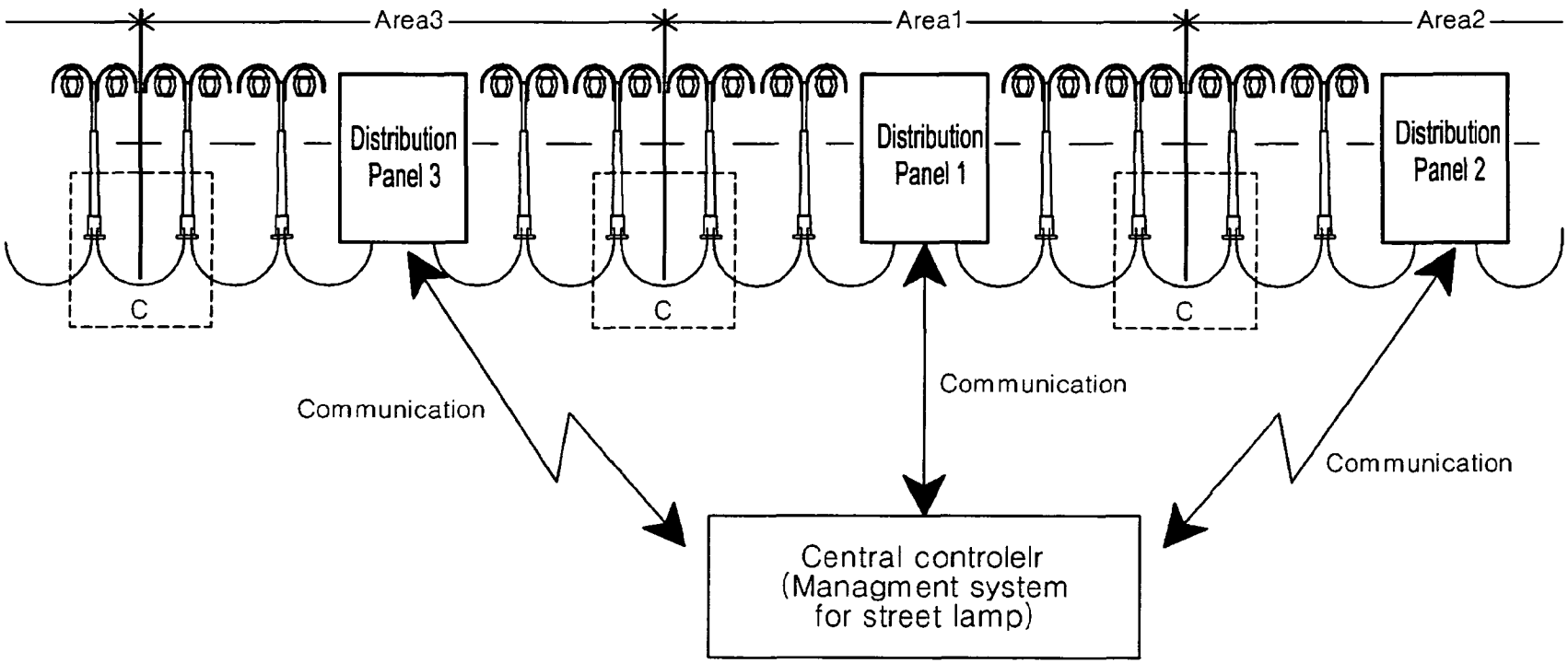
FIG. 2 is a view illustrating connections of a street lamp control system in accordance with a first embodiment of the present invention.

Referring to FIG. 2, the present invention is configured to divide areas where a predetermined number of street lamps are to be installed into several areas Area 1 to Area N (N is an integer number greater than 1), to install one distribution panel (distribution panel 1 to distribution panel N) in a center of each area (Area 1 to Area N), to allow each distribution panel (distribution panel 1 to distribution panel N) to have two power source control switching circuits for controlling right and left power sources in the corresponding area, to have the power source switching circuit of the corresponding distribution panel turn off not only an abnormal street lamp but right and left street lamps of the abnormal street lamp when an abnormal state of the abnormal street lamp in a specific area group is sensed, and to keep the right and left street lamps being supplied with the power except the abnormal street lamp having the abnormal state.

Figure 3:
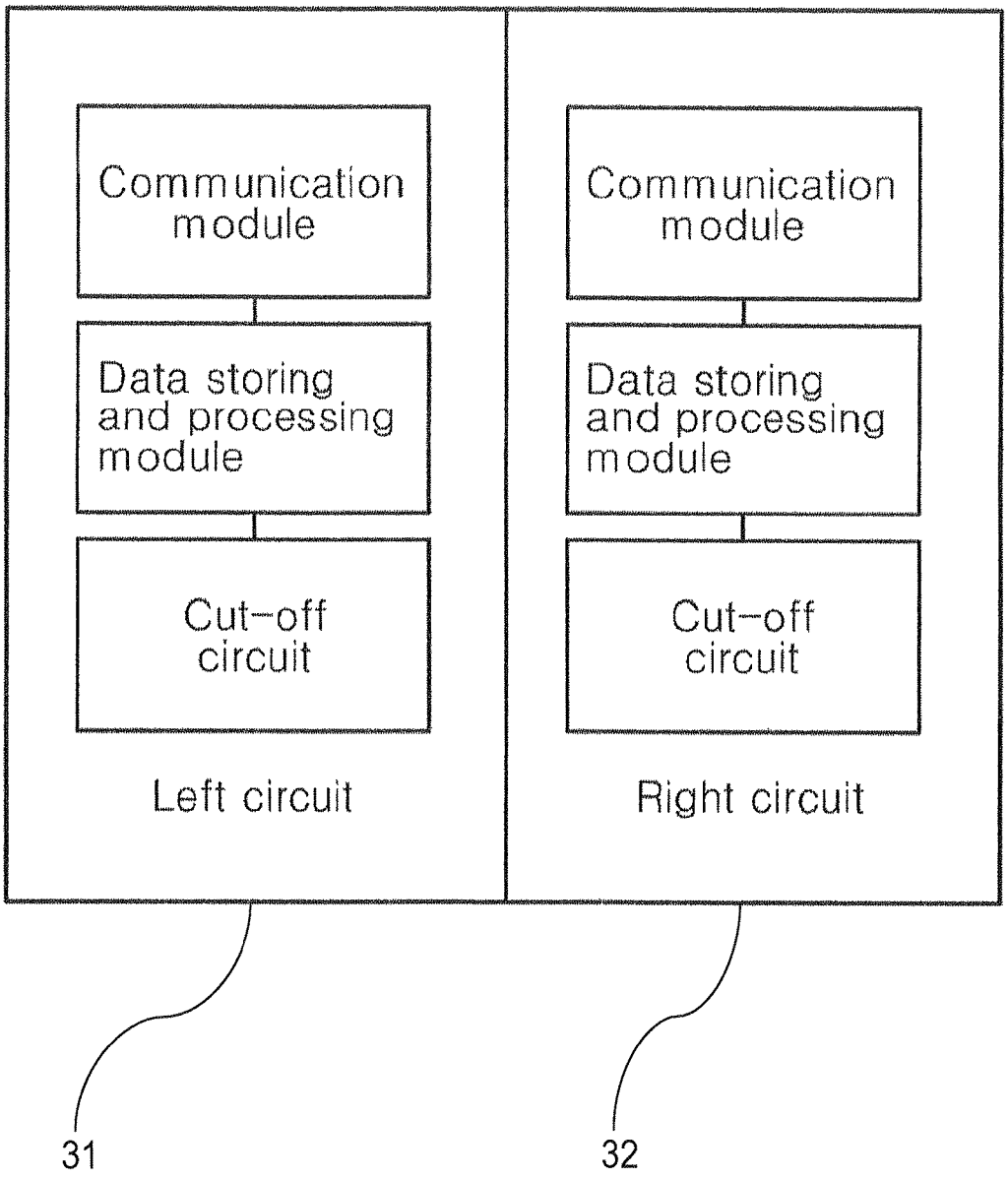
FIG. 3 is a block diagram illustrating a distribution panel in accordance with the present invention.
Figure 4:
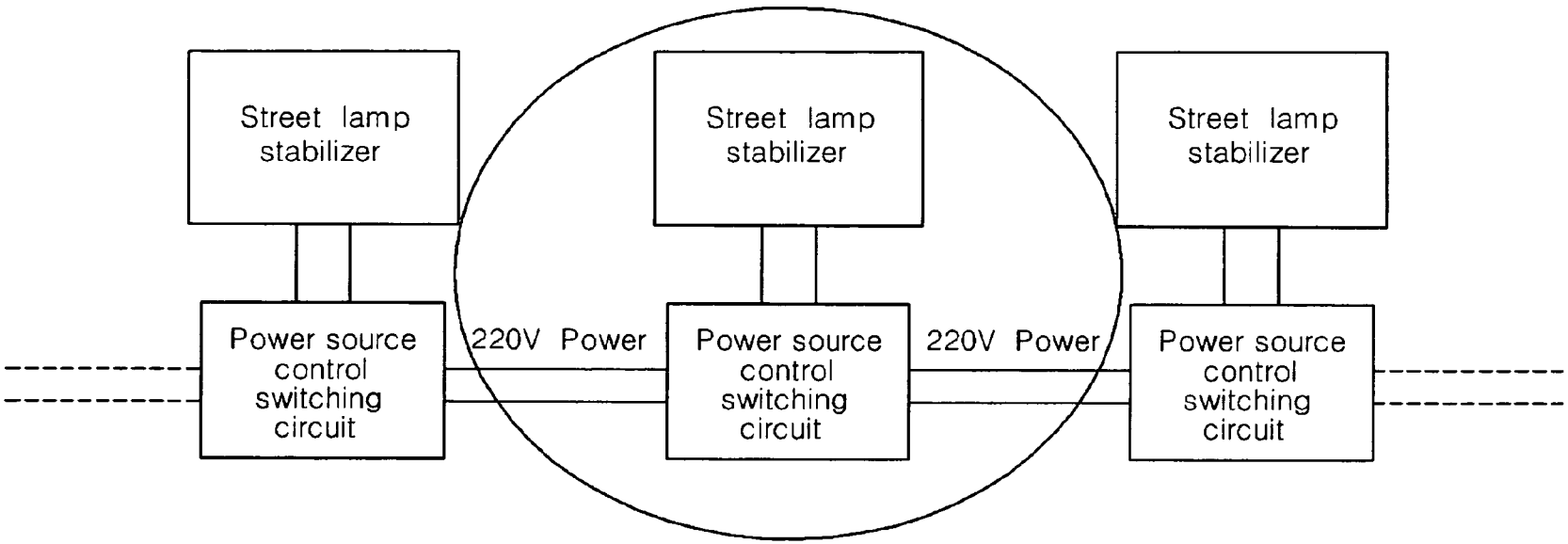
FIG. 4 is a block diagram illustrating a power source control switching circuit in accordance with the present invention.

To this end, each distribution panel has the configuration as shown in FIG. 3, which controls the right and left power sources of the corresponding area to turn off the corresponding street lamp, and has the conventional B shown in FIG. 1 and C shown in FIG. 2 configured as shown in FIG. 4 so that the power source around the street lamp pole having the abnormal state on safety is turned off and power sources of street lamps poles having no problems are supplied with powers via other supply routes.

Accordingly, the switching circuit could be configured as shown in FIG. 4 to control supplying the power to both right and left street lamps.

One power source control switching circuit of FIG. 4 is installed in each street lamp pole, which operates power source control switching circuits disposed at right and left sides of the abnormal street lamp pole to completely cut off the power source of the abnormal street lamp pole. To this end, when a current (or voltage) exceeding a predetermined safety value is sensed by a current or voltage sensor included in a street lamp pole, this data is transmitted to a data storing and processing module in the distribution panel of FIG. 3, a communication module transmits this data to a central controller (street lamp management system), which is then notified to a manager as an alarm, and the central controller cuts off the abnormal street lamp from the power source by issuing a command of cutting off the power sources of the right and left street lamps of the abnormal street lamp, and controls the power source control switching circuit corresponding to the portion C of FIG. 2 for supplying street lamps having no problems with power and issues a check command for checking the abnormal street lamp after the power is supplied.

Figure 5:
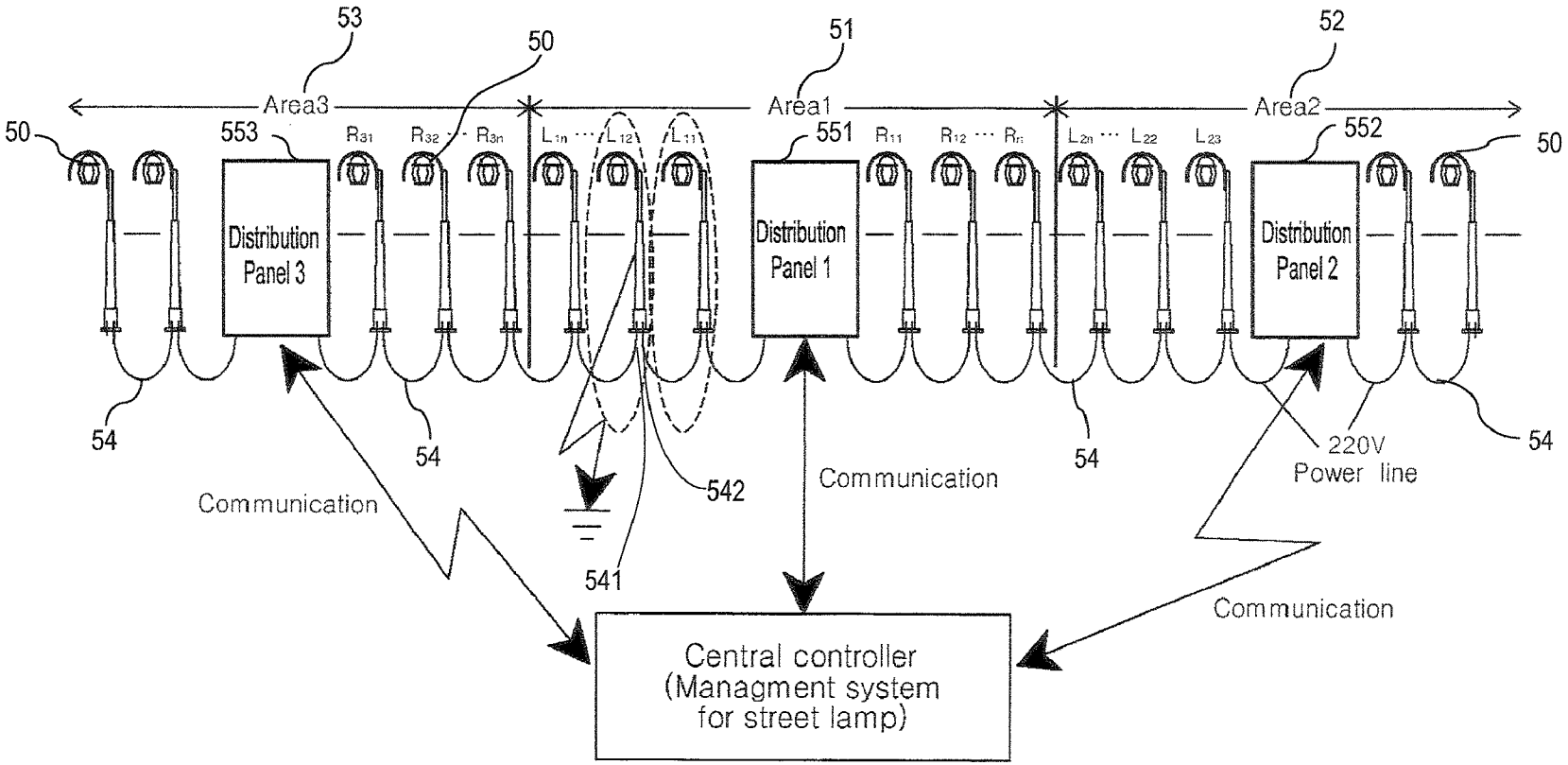
FIG. 5 is a view in accordance with an embodiment of the present invention.

FIG. 5 shows a detailed embodiment of the present invention, which sends a command of opening the left power source switching circuit of the street lamp $L_{11}$ and the right power source $L_{13}$ of the street lamp to completely isolate the street lamp $L_{12}$ from the power sources when data about a dangerous situation or electric leakage of the street lamp $L_{12}$ is sent to the management system for street lamp via the distribution panel. In this case, the power is not supplied to the street lamps $L_{13}$ to $L_n$ even when the street lamps are in a normal state, however, the street lamps $L_{13}$ to Ln may be turned on again via the installed power line (C portion of FIG. 2) when the power source circuit of $R_{3n}$ to which the power is to be supplied is cut off by the distribution panel 3.

Referring to FIG. 5, R and L denote right and left sides connected to the corresponding distribution panel, and a first character denotes a number of the distribution panel, and a second character denotes an identification number of the connected street lamp in the distribution panel.

Accordingly, the management system for street lamp notifies a maintenance entity of the corresponding area upon completion of the power manipulation to have the entity check and repair the corresponding street lamp pole, and controls the power in the reverse order of the occurrence of the abnormal state when the repairing is finished to return the system to a normal state.

Hereinafter, a remote street lamp control system according to a second embodiment of the present invention will be described.

A plurality of street lamps are connected to a line branched off from a distribution panel. The conventional monitoring and street lamp control system is configured to cut off the whole street lamps even when any one of installed street lamps is out of order due to an electric leakage or the like, however, the present invention is intended to enhance reliability and stability and to allow street lamps to be controlled in a group or individual way by improving such problems.

Figure 6:
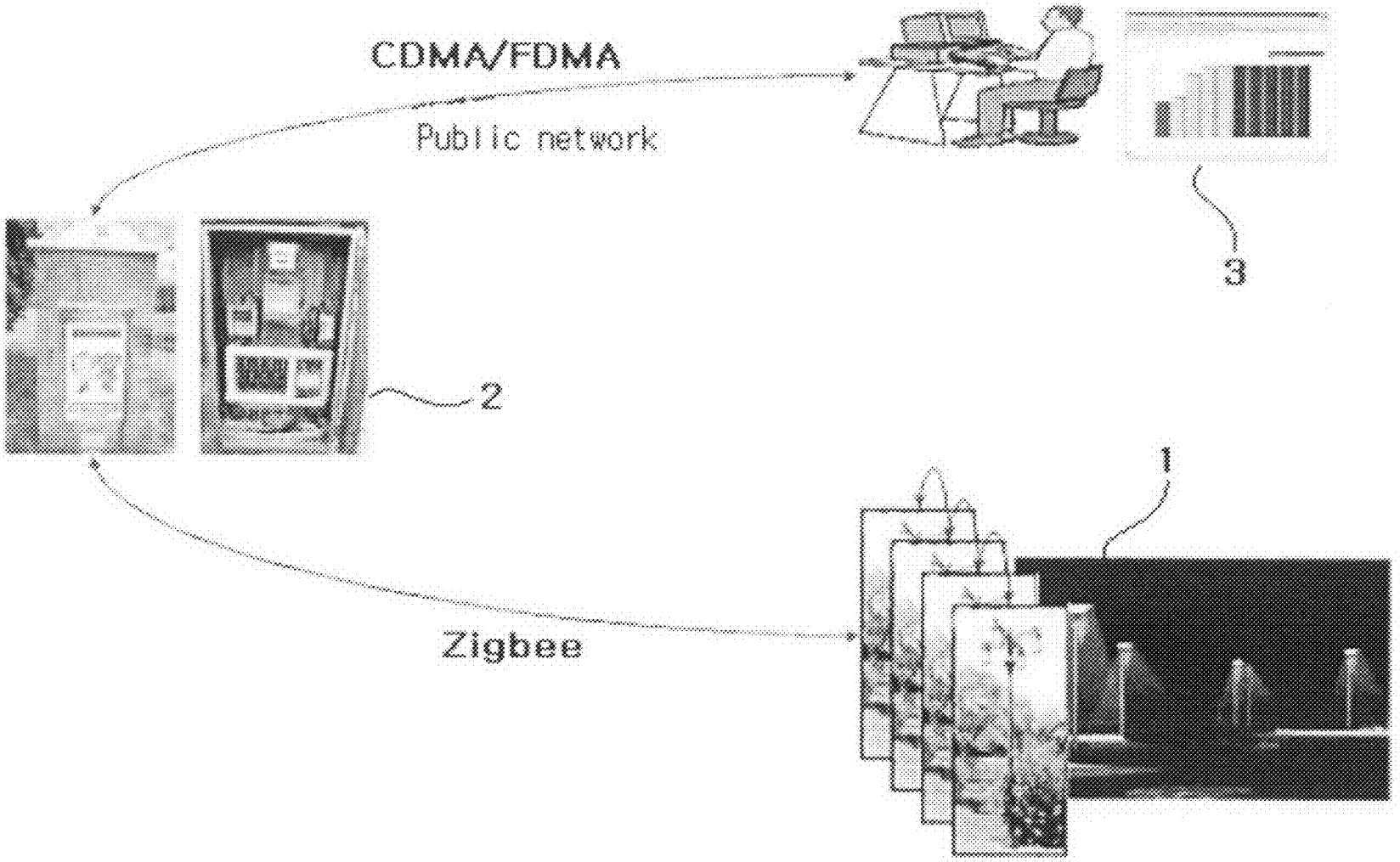
FIG. 6 is a view illustrating a whole configuration of a remote street lamp control system using a low power radio communication technique in accordance with a second embodiment of the present invention.

Therefore, as shown in FIG. 6, according to the remote street lamp control system of the present invention, the local controller 2 and the light controller for street lamp 1 are connected by Zigbee, and the local controller 2 and the central control computer 3 are connected via a bidirectional radio communication network, so that the local controller 2 of the distribution panel can remote-control turning on/off the street lamps in a group or individual way, thereby maintaining and managing the system in a more effective and safer way.

In other words, according to the present invention employing the Zigbee technique, the abnormal street lamp only can be isolated and separated from the rest street lamps when any one street lamp is out of order so that the rest street lamps except the abnormal one can perform the respective functions in a normal way. When the Zigbee communication is employed, a separate communication charge is not required, and control for street lamp can be done in a group or individual way other than the conventional group control way, thereby enhancing reliability and stability.

Figure 7:
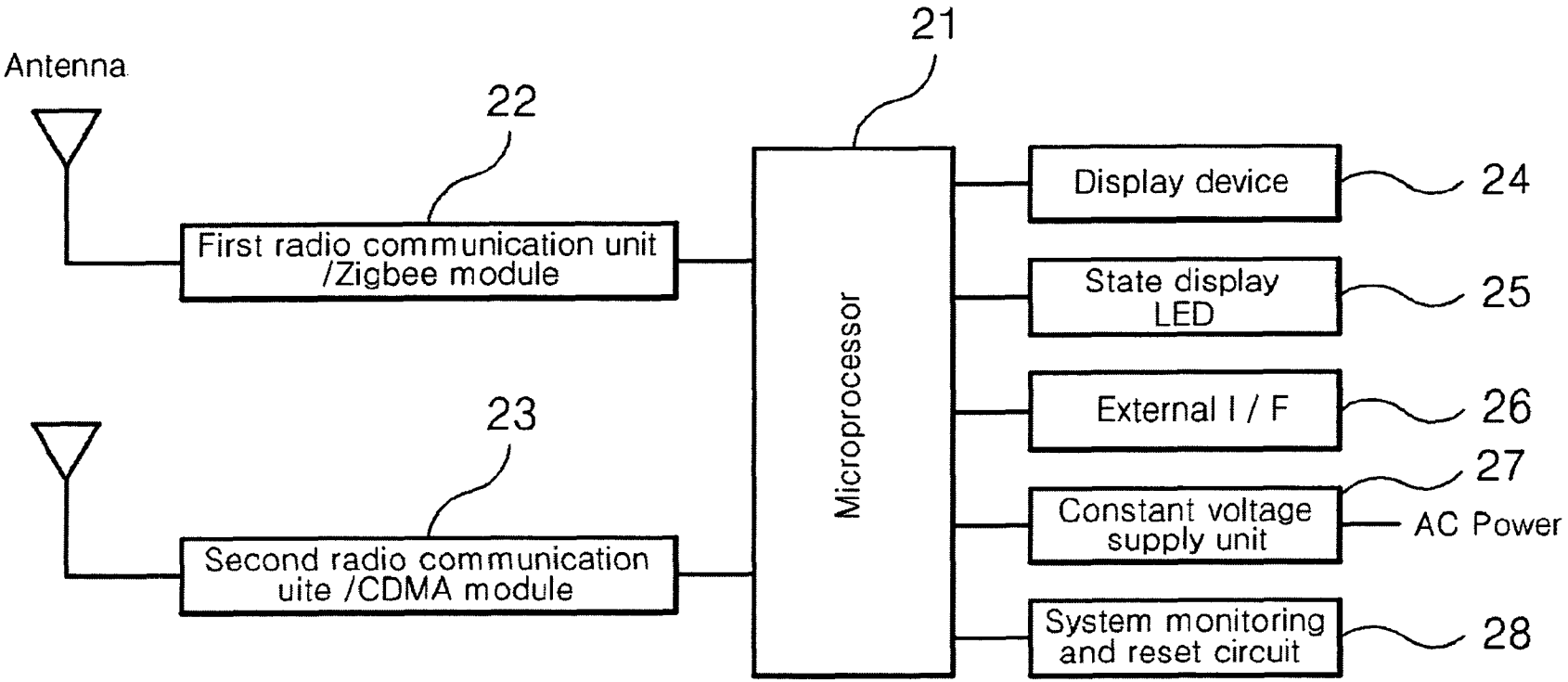
FIG. 7 is a detailed block diagram illustrating a local controller of FIG. 6.

FIG. 7 illustrates a block diagram of the local controller 2 as one of components of the present invention, the local controller 2 actually implement individual control and group control by exchanging information and a control signal with the light controller for street lamp 1 installed in each of the street lamp poles, and the radio communication unit/Zigbee module 22 of FIG. 2 acts to allow the local controller 2 and the light controller for street lamp 1 to exchange information there between.

Figure 8:
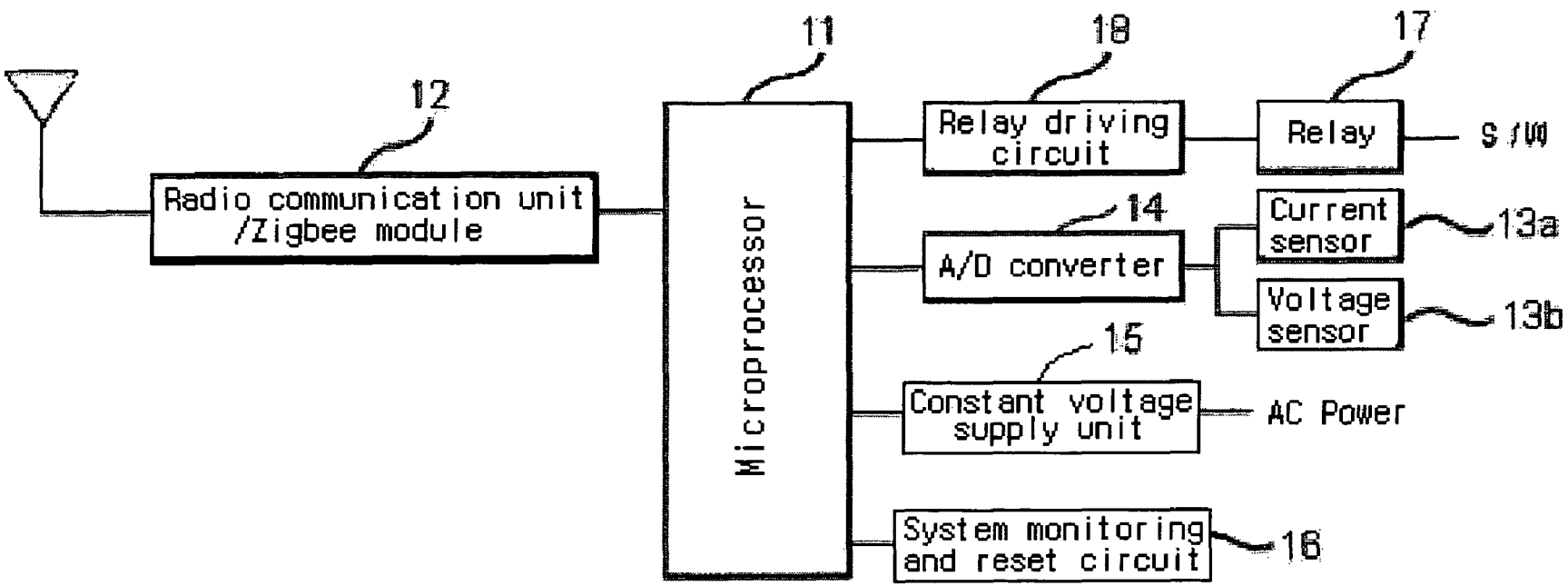
FIG. 8 is a detailed block diagram illustrating an individual street lamp controller installed in each of street lamp poles of FIG. 7.

FIG. 8 is a detailed block diagram illustrating a street lamp light controller 1 installed in an individual street lamp pole, which performs exchanging information with the local controller 2 shown in FIG. 7 and actually controls each of the respective street lamps in accordance with individual and group control commands from the local controller 2.

Referring to FIG. 7, a local controller 2 includes a microprocessor 21 processing general functions such as information transmission, information storage, state display, a first radio communication unit/Zigbee module 22 communicating with a street lamp light controller 1, a second radio communication unit 23 for exchanging information with a control computer of a central control center 3, a display device 24 for displaying various measurements and communication states, a state display light emitting diode (LED) 25 for displaying operating states of the local controller 2, an external interface (I/F) unit 26 for data update and maintenance of the local controller 2, a constant voltage supply unit 27 for supplying a voltage, and a system monitoring and reset circuit 28.

Referring to FIG. 8, the individual street lamp controller 1 includes a microprocessor 11 processing general functions such as information transmission, information storage, state display, a radio communication unit/Zigbee module 12 for receiving a control command from the local controller 2, current and voltage sensors 13*a* and 13*b* for sensing an abnormal state of a street lamp, an analog/digital (A/D) converter 14 for converting an analog signal sensed by the sensors 13*a* and 13*b* to a digital signal and inputting the digital signal to the microprocessor 11, a constant voltage supply unit 15 for supplying a voltage, a system monitoring and reset circuit 16, and relay driving circuit 18 for receiving a control command via the radio communication unit/Zigbee module 12 upon occurrence of abnormal state and driving the relay 17 in accordance with the received control command to cut off the power of the corresponding street lamp.

Operating states of the present invention having the above-described configuration will be described.

First, when an abnormal state occurs on any specific street lamp, the current sensor 13*a* or the voltage sensor 13*b* of the street lamp light controller 1 shown in FIG. 3 senses the abnormal state and inputs it to the A/D converter 14, and then the A/D converter 14 decodes the sensed value to be input to the microprocessor 11.

At this time, the microprocessor 11 sends an indicative signal of an abnormal state occurrence on any specific street lamp to the local controller 2 shown in FIG. 7 via the radio communication unit/Zigbee module 12.

Accordingly, the signal of the abnormal state from the street lamp light controller 1 is transmitted via the radio communication unit/Zigbee module 22 of the local controller 2, and at this time, the microprocessor 21 transmits the signal to the central control center 3 via the radio communication unit/CDMA modem 23.

When the abnormal state signal about the specific street lamp is received by the central control center 3, the central control center 3 sends a control command and a command for maintenance function to the local controller 2, the local controller 2 transmits a command to the light controller for street lamp 1 where the abnormal state has occurred via the radio communication unit/Zigbee module 22 upon receipt of the commands via the radio communication unit 23, and the light controller for street lamp 1 drive the relay 17 with the relay driving circuit 18 to cut off the power source of the street lamp in accordance with the received commands.

Accordingly, the light controller for street lamp 1 executes the commands and sends information about the result to the local controller 2, and the local controller 2 sends again the collected information to the central control center 1 via the second radio communication module 23 so that the whole monitoring, control, and maintenance can be executed.

According to the present invention as described above, safety and effective management of an operating system for street lamp can be enhanced, an electric shock risk can be solved by individual control for power source of street lamp, and disaster due to darkness where power of the street lamp is lost can be prevented.

Also, according to the present invention, when any one street lamp is out of order, the abnormal street lamp can be cut off and isolated by remote control so that the rest street lamps except the abnormal street lamp can perform the respective functions in a normal way, a low power radio communication technique is employed so that a separate communication charge is not required, and group control and individual control can be implemented for the street lamps other than the conventional group control so that reliability and stability can be enhanced. Individual control for the street lamp which could not be available in the related art can be implemented so that each of the street lamps can be controlled and a street lamp having an abnormal state due to an electric leakage or the like can be excluded so that loss of life due to an electric shock can be reduced by enhancing safety, and the whole street lamps can also be prevented from being cut off due to the specific street lamp so that an occurrence of civil application can be removed and inconvenience can be mitigated. Also, every state of the street lamp can be checked so that human resources for maintenance and cost and time required for the same can be significantly reduced. Further, the present invention employs a low power technique as a radio communication technique so that an interference between adjacent controllers and an interference of other peripheral equipment are not present, a separate communication charge is not required, and optimal communication between street lamps with an interval of about 50 m can be implemented.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

The present invention discloses a street lamps control system in a region divided into a plurality of areas. As show in FIG. 5, the street lamp control system includes a plurality of street lamps 50 being disposed in each of the plurality of areas 51, 52, 53 and the street lamps disposed within each of the areas being serially connected to each other by power lines 54 providing power (for example, 220V) to each lamp; a plurality of distribution panel 551, 552, 553 each installed at a corresponding center of the plurality of areas 51, 52, 53, the distribution panel including power source control switching circuits 31, 32 (as shown in FIG. 3) respectively controlling the power provided to the each street lamp; and a plurality of sensors coupled to corresponding ones of the distribution panel and disposed to respond to an abnormal state occurring to a street lamp $L_{12}$ disposed in a first area 51 having a first distribution panel 551. When the sensors detect the abnormal state in the street lamp $L_{12}$, the power source control switching circuits 31, 32 controlling the power provided to the street lamp $L_{12}$ cut off the power provided to the street lamp $L_{12}$, and street lamps $L_{13}$ through $L_{1n}$ disposed in the first area 51 are disconnected from power provided by the first distribution panel 551 and are alternatively provided by power supplied by a second distribution panel 553 disposed within a second area 53 neighboring the first area 51. The power is generally provided from right side 542 and left side 541 by corresponding power lines 54 to the lamp, for example, lamp $L_{12}$.

What is claimed is:

1. A street lamp control system disposed in a region divided into a plurality of areas, the street lamp control system comprising:

a plurality of street lamps being disposed in each of the plurality of areas with the street lamps within each of the areas being serially connected to each other by power lines providing power to each street lamp;

a plurality of distribution panels each installed at a center of each corresponding area, the distribution panel including power source control switching circuits respectively controlling the power provided to each street lamp within the corresponding area; and a plurality of sensors coupled to different corresponding ones of the distribution panels and disposed to respond to an abnormal state occurring to a street lamp disposed in a first area having a first distribution panel, the power source control switching circuits controlling the power provided to the street lamp having the abnormal state by cutting off the power provided to the street lamp having the abnormal state, and street lamps disposed in the first area which are different from the street lamp having the abnormal state and are disconnected from power provided by the first distribution panel being provided by power supplied by a second distribution panel disposed within a second area neighboring the first area.

2. The street lamp control system as set forth in claim 1, wherein the first distribution panel senses the abnormal state of the street lamp and transmits a result sensed to a control center in a remote way in order to cut off the power provided to the street lamp having the abnormal state.

3. The street lamp control system as set forth in claim 2, wherein the abnormal state of the street lamp is sensed by a current or voltage sensor.

4. A street lamp control system for remote-controlling street lamps using low power radio communication, comprising:

a street lamp light controller installed in a street lamp pole, and exchanging information with a local controller and simultaneously controlling a street lamp installed at the street lamp pole in accordance with an individual control command and a group control command transmitted from the local controller;

the local controller exchanging information and a control signal with street lamp light controllers each installed at a corresponding street lamp pole to control the corresponding street lamp in individual and group ways;

a central control center controlling the local controller in order to enable the corresponding street lamp to be controlled in the group and individual ways; and the local controller and the street lamp light controller being connected in a low power radio communication protocol, ZigBee, and the local controller and the central control center being connected via a bidirectional radio communication network.

5. The street lamp control system as set forth in claim 4, wherein the street lamp light controller comprises:

a microprocessor processing general functions including information transmission, information storage, and state display;

a radio communication unit for receiving a control command from the local controller;

a current and voltage sensor for sensing an abnormal state of the street lamp;

an analog/digital converter for converting an analog signal of the street lamp sensed by the current and voltage sensor into a digital signal, and outputting the digital signal to the microprocessor;

a constant voltage supply unit for supplying a power; and a relay driving circuit for driving the relay of the distribution panel to cut off a power of the corresponding street lamp in accordance with the received control command.

6. The street lamp control system as set forth in claim 4, wherein the local controller comprises:

a microprocessor processing general functions including information transmission, information storage, and state display;

a radio communication unit communicating with the street lamp light controller;

a radio communication unit for exchanging information with a control computer of the central control center;

a display device for displaying various measurements and communication states;

a state display light emitting diode for displaying an operating state of the local controller;

an external interface unit performing maintenance and data update of the local controller; and a constant voltage supply unit for supplying a power.

7. The street lamp control system as set forth in claim 5, with the radio communication unit being a ZigBee module.

8. The street lamp control system as set forth in claim 6, with the radio communication unit being a ZigBee module.

9. A street lamp control system, comprising:

a plurality of street lamps;

a plurality of distribution panels discretely installed among the plurality of street lamps, a predetermined number of street lamps disposed between two neighboring distribution panels, and the plurality of street lamps serially electrically connected to each other by power lines each providing power to a corresponding street lamp; and a plurality of sensors coupled to corresponding ones of the distribution panels and disposed to respond to an abnormal state occurring to a street lamp, one of distribution panels neighboring the street lamp having the abnormal state disconnecting the power provided to the street lamp having the abnormal state, and the other distribution panel neighboring the street lamp providing power to street lamps which are different from the street lamp having the abnormal state and are disconnected from power provided from the one of distribution panel neighboring the street lamp.

* * * * *